US005723948A

United States Patent [19]

Yoshida

[11] Patent Number: 5,723,948

[45] Date of Patent: Mar. 3, 1998

[54] HELIX TRAVELLING-WAVE TUBE WITH A MAXIMUM SMALL SIGNAL GAIN AT THE OPERATING VOLTAGE

[75] Inventor: Mitsuru Yoshida, Tokyo, Japan

[73] Assignee: NEC Corporation, Tokyo, Japan

[21] Appl. No.: 724,863

[22] Filed: Oct. 3, 1996

[30] Foreign Application Priority Data

Oct. 4, 1995 [JP] Japan ..... 7-257868

[51] Int. Cl.[6] ..... H01J 25/34

[52] U.S. Cl. ..... 315/3.6; 315/39.3

[58] Field of Search ..... 315/3.5, 3.6, 39.3; 333/162, 163

[56] References Cited

U.S. PATENT DOCUMENTS 3,324,342 6/1967 Eallonardo ..... 315/3.6

4,378,512 3/1983 Tsutaki ..... 315/3.6

5,162,697 11/1992 Davis et al. ..... 315/3.6

FOREIGN PATENT DOCUMENTS 57-170440 10/1982 Japan .

*Primary Examiner*—Robert Pascal

*Assistant Examiner*—Justin P. Bettendorf

*Attorney, Agent, or Firm*—Sughrue, Mion, Zinn, Macpeak & Seas, PLLC

[57] ABSTRACT

A helix travelling-wave tube of the present invention includes a helix wave delay circuit having velocity tapers for improving a beam efficiency and reducing backward wave oscillation. The tube allows a small signal and a large signal synchronous voltage to coincide or be extremely close to each other and thereby allows its circuit to have a minimum length. The tube is therefore small size and light weight and involves a minimum of gain variation against voltage variation.

3 Claims, 8 Drawing Sheets

1
2
3
4
5
6
7
8
9
E
CIRCUIT PERIOD
P0
P1 (−0.1<B<0.1)
P1 (1.95<B<2.05)
AXIAL DISTANCE

• : EXPERIMENTS
× : SIMULATION
INPUT POWER
Pd=−2dBm
GREAT
SIGNAL
SYNC
VOLTAGE
(5.52KV)
INPUT POWER
Pd=−22dBm
SMALL SIGNAL SYNC
VOLTAGE (5.15KV)
OUTPUT POWER (dBm)
55
50
45
40
35
30
4.5
5.0
5.5
6.0
HELIX VOLTAGE (KV)

HELIX TRAVELLING-WAVE TUBE WITH A MAXIMUM SMALL SIGNAL GAIN AT THE OPERATING VOLTAGE

BACKGROUND OF THE INVENTION

The present invention relates to a helix travelling-wave (TW) tube and, more particularly, to a helix TW tube having a helix wave delay circuit for improving a beam efficiency and reducing backward wave oscillation.

Generally, a helix TW tube has an electron gun for emitting an electron beam, a helix wave delay circuit for causing the electron beam and high frequency to interact with each other, a high frequency input section for inputting the high frequency to the wave delay circuit, a high frequency output section for outputting the high frequency, and a magnetic field device for causing the electron beam to converge to a preselected diameter during propagation through the wave delay circuit. For the interaction between the electron beam and the high frequency, it is necessary that electrons has a velocity substantially equal to the phase velocity of the high frequency.

While the velocity at which high frequency propagates straight on is substantially equal to the velocity of light, electrons cannot propagate at the velocity of light. The helix wave delay circuit allows the high frequency to propagate along its helix at the velocity of light. On the other hand, assuming that the helix has a circuit period P and a diameter $2a$, then the delay circuit allows the high frequency to propagate at a speed $P(2a\pi)$ times the velocity of light in the axial direction of the helix which is parallel to the direction of propagation of the electron beam. The high frequency forms an electric field on the helix, so that the electron beam input to the delay circuit is decelerated or accelerated. It is to be noted that the words "circuit period" refer to the period of the helix and is sometimes referred to as a helix pitch.

So long as the velocity of the electron beam and the phase velocity of the high frequency are exactly the same, the amount of decelerated electrons and that of accelerated electrons are equal. In this condition, the electron beam and high frequency do not interact with each other, so that amplification is not effected. When the velocity of the electron beam is selected to be slightly greater than the phase velocity of the high frequency, a dense group of electrons concentrate on the deceleration region of the high frequency electric field formed on the helix. In the deceleration region, the electrons are decelerated with the result that a difference in kinetic energy between the initial velocity and the lowered velocity is transformed to the energy of the high frequency. In this manner, the high frequency electric field on the helix is intensified, and in turn promotes the velocity modulation of the electrons. As a result, the electric field is further intensified. Because such interaction occurs continuously as the electron beam and high frequency advance, the energy of the high frequency sequentially increases toward the output end of the helix, i.e., the high frequency is amplified.

As stated above, in the helix TW tube, high frequency (microwave) is propagated through the helix. By varying the circuit frequency, it is possible to vary the axial velocity component of the high frequency. It has therefore been customary to provide a velocity taper for causing the pitch of the helix to vary as some function of the axial distance of the helix. In this configuration, the phase velocity of the circuit wave is lowered in the form of a taper in matching relation to the decrease in the velocity of the electron beam between a high frequency attenuator and the high frequency output section. The velocity taper enhances the beam efficiency and reduces backward wave oscillation. This kind of approach is taught in, e.g., Japanese Patent Laid-Open Publication No. 57-170440.

The TW tube or high frequency amplifier amplifies given high frequency input power. So long as the high frequency input power is small, the output voltage of the tube is proportional to the input power. The operation to occur in this range is referred to as a small signal operation. When the input power exceeds the above range, the tube operates nonlinearly and in due cause reaches its limit output (saturation output). This is referred to as a large signal operation. In this respect, the conventional TW tube with the velocity taper has the following problems.

When the voltage to be applied to the helix is varied to vary the velocity of the electron beam, a deviation as large as about 7 % of the operation voltage occurs between a small signal synchronous voltage providing the maximum small signal gain and a large signal synchronous voltage providing the maximum output. From the total efficiency standpoint, it is necessary to set the operation voltage of the TW tube at a voltage providing the maximum output. This, however, lowers the gain by an amount corresponding to the difference in voltage between the small signal and the large signal. The decrease in gain cannot be made up for unless the circuit length and therefore the size of the TW tube is increased. Moreover, because the gain variation increases against the operation voltage variation, a power source for driving the tube needs extreme stability.

SUMMARY OF THE INVENTION

It is therefore an object of the present invention to provide a helix TW tube which is small size and light weight and causes the gain to change little against the variation of power.

In accordance with the present invention, in a TW tube having an electron gun, a collector, a high frequency input section, a high frequency output section, and a helix wave delay circuit divided halfway by a high frequency attenuator with respect to frequency, the helix wave delay circuit has a uniform circuit period P0 portion having a uniform circuit period P0, a velocity taper portion where a circuit period varies from P0 to P1, a uniform circuit period P1 portion having a uniform circuit period P1 greater than P0, a velocity taper portion where the circuit period varies from P1 to P2, and a uniform circuit period P2 portion having a uniform circuit period P2 smaller than P1, as named from the side adjoining the high frequency input section. A velocity coefficient B expressed, assuming that a circuit wave has a phase velocity v0, that electrons have a DC velocity u0, and that the circuit has a coupling coefficient C, as:

$$B=(u0-v0)/(C\cdot v0) \qquad \text{Eq. (0)}$$

is confined, in the uniform circuit period P1 portion, in a range of:

$$-0.1<B<0.1 \qquad \text{Eq. (1)}$$

and confined, in the uniform circuit period P2 portion, in a range of:

$$1.95<B<2.05 \qquad \text{Eq. (2)}$$

A difference $\Delta B$ between the two velocity coefficients B is selected to lie in a range of:

$$1.95<\Delta B<2.1 \qquad \text{Eq. (3)}$$

The uniform circuit period P0 portion and uniform circuit period P1 portion each has a particular length selected such that a small signal gain becomes maximum at a voltage satisfying the Eqs. (1)–(3).

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
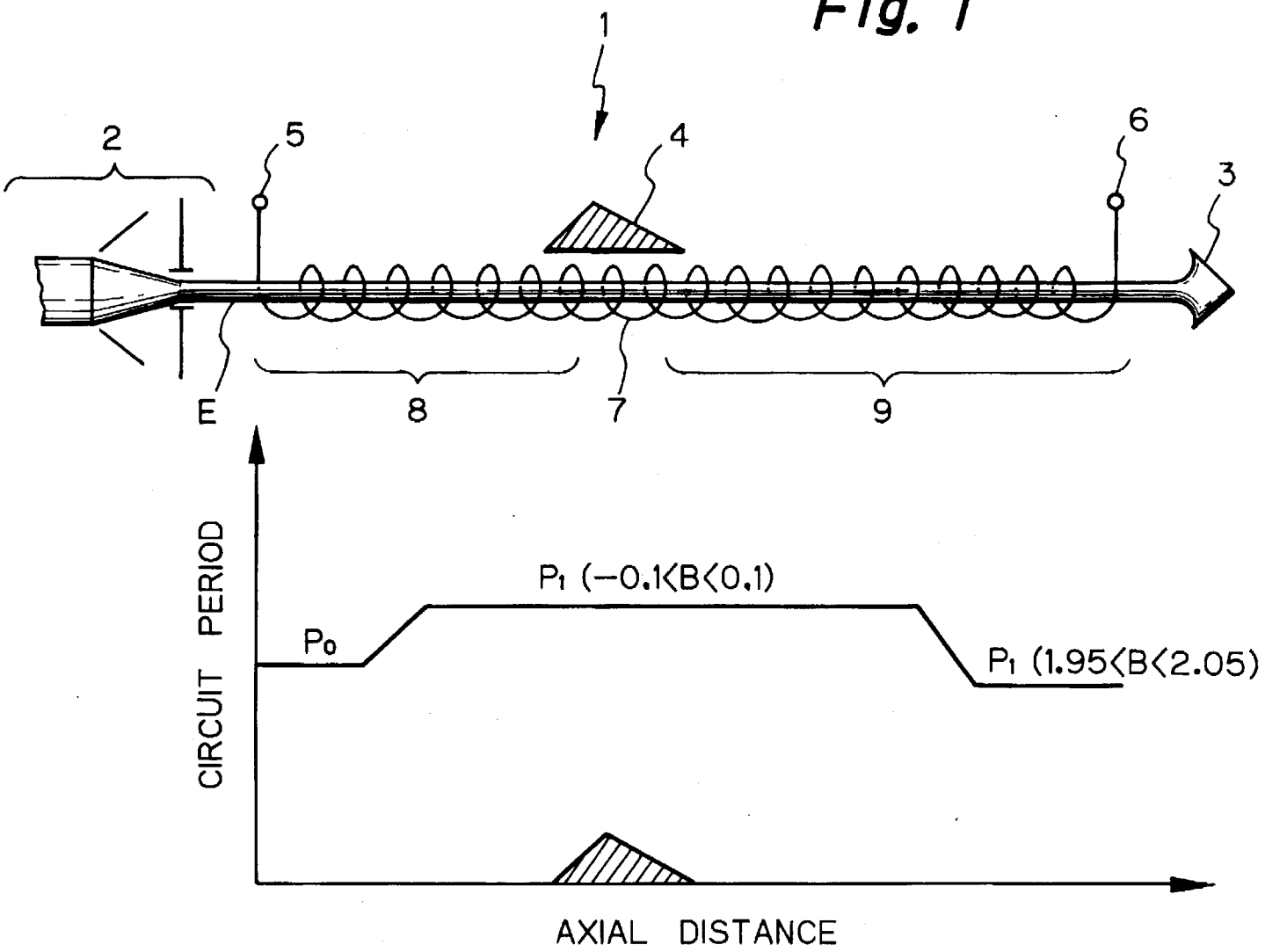
FIG. 1 shows a helix TW tube embodying the present invention together with circuit periods particular to a helix wave delay circuit included in the tube.

Referring to FIG. 1 of the drawings, a helix TW tube embodying the present invention is shown. As shown, the TW tube 1 has an electron gun 2, a collector 3, a wave attenuator (high frequency attenuator) 4, a wave input section (high frequency input section) 5, a wave output section (high frequency output section) 6, and a helix wave delay circuit 7. The wave input section 5 and wave output section 6 adjoin the electron gun 2 and collector 3, respectively. The wave delay circuit 7 is made up of two portions 8 and 9 terminating at the wave input section 5 and wave output section 6, respectively. The wave attenuator 4 is located at a position where the two portions 8 and 9 join each other.

The wave delay circuit 7 has a circuit period configuration also shown in FIG. 1. The inlet portion 8 adjoining the wave input section 5 is implemented as a uniform circuit period P0 portion having a uniform circuit period P0. The uniform circuit period P0 portion merges into a uniform circuit period P1 portion having a uniform circuit period P1 via a velocity taper portion. The uniform circuit period P1 portion merges into a uniform circuit period P2 portion having a uniform circuit period P2 via another velocity taper portion. The circuit period P2 is shorter than the circuit period P1. While the two velocity taper portions are shown as being linear, they may, of course, be based on any preselected function.

Assume that the circuit wave has a phase velocity v0, that electrons have a DC velocity u0, and that the circuit has a coupling coefficient C. Then, a velocity coefficient B is expressed as:

$$B=(u0-v0)/(C\cdot v0) \qquad \text{Eq. (0)}$$

In the circuit period P1 portion, the velocity coefficient B is selected to lie in the following range:

$$-0.1<B<0.1 \qquad \text{Eq. (1)}$$

In the circuit period P2 portion, the velocity coefficient B is confined in the following range:

$$1.95<B<2.05 \qquad \text{Eq. (2)}$$

Further, the difference ΔB between the above two velocity coefficients B is selected to lie in the following range:

$$1.95<\Delta B<2.1 \qquad \text{Eq. (3)}$$

The circuit period P0 portion and circuit period P1 portion each has a particular length selected such that a small signal gain becomes maximum at a voltage satisfying the above Eqs. (1)–(3), by a method which will be described later.

The coupling coefficient C, or coupling parameter or gain parameter as sometimes referred to, is expressed as:

$$C^3=K0\times I0/(4\times V0)$$

where K0 denotes a coupling impedance, I0 denotes the current of an electron beam, and V0 denotes a helix voltage. The coupling impedance is determined by an electric field acting on an electron beam and is representative of the intensity of interaction between an electron beam and a high frequency.

The previously mentioned DC velocity u0 of electrons refers to a velocity at which electrons are input to the helix wave delay circuit 7 when accelerated by a voltage applied to the circuit 7. The phase velocity v0 of the circuit wave is approximately equal to the velocity of light. Assuming that the circuit period is P and that the helix diameter is $2a$, the phase velocity refers to a velocity at which the high frequency propagating through the helix is decelerated to $P(2a\pi)$. High frequency amplification by a helix delay circuit has a distribution against the DC velocity of electrons. Therefore, when the circuit period varies in the axial direction, the distribution accumulates for each circuit period. In light of this, when the small signal synchronous voltage is lower than a preselected voltage, the circuit period P0 portion and P1 portion are respectively configured short and long. Conversely, when the above synchronous voltage is higher than the preselected voltage, the circuit period P0 portion and P1 portion are respectively configured long and short.

Regarding the computer simulation of the operation of a TW tube, a small signal is usually simulated on the basis of the small signal theory, and the simulation of this signal has already come to stay. However, as for a large signal, computer simulation is not fully relied on because the phenomenon is not linear and involves many unclear portions. In the illustrative embodiment, physical parameters are used in relation to the behavior of a large signal and combined with the small signal theory, thereby promoting easy design.

The velocity coefficient B represented by the Eq. (0) is used to confine the velocity coefficients B of the circuit period P1 portion and P2 portion and their difference ΔB in the ranges represented by the Eqs. (1)–(3), respectively. However, because varying the DC velocity u0 of electrons and the coupling coefficient C of the circuit is extremely difficult, the phase velocity v0 of the circuit wave is varied.

The easiest way to vary the phase velocity v0 is to vary the circuit period. Therefore, the circuit periods of the circuit period P1 portion and P2 portion are so determined as to satisfy the Eqs. (1)–(3).

Figure 2:
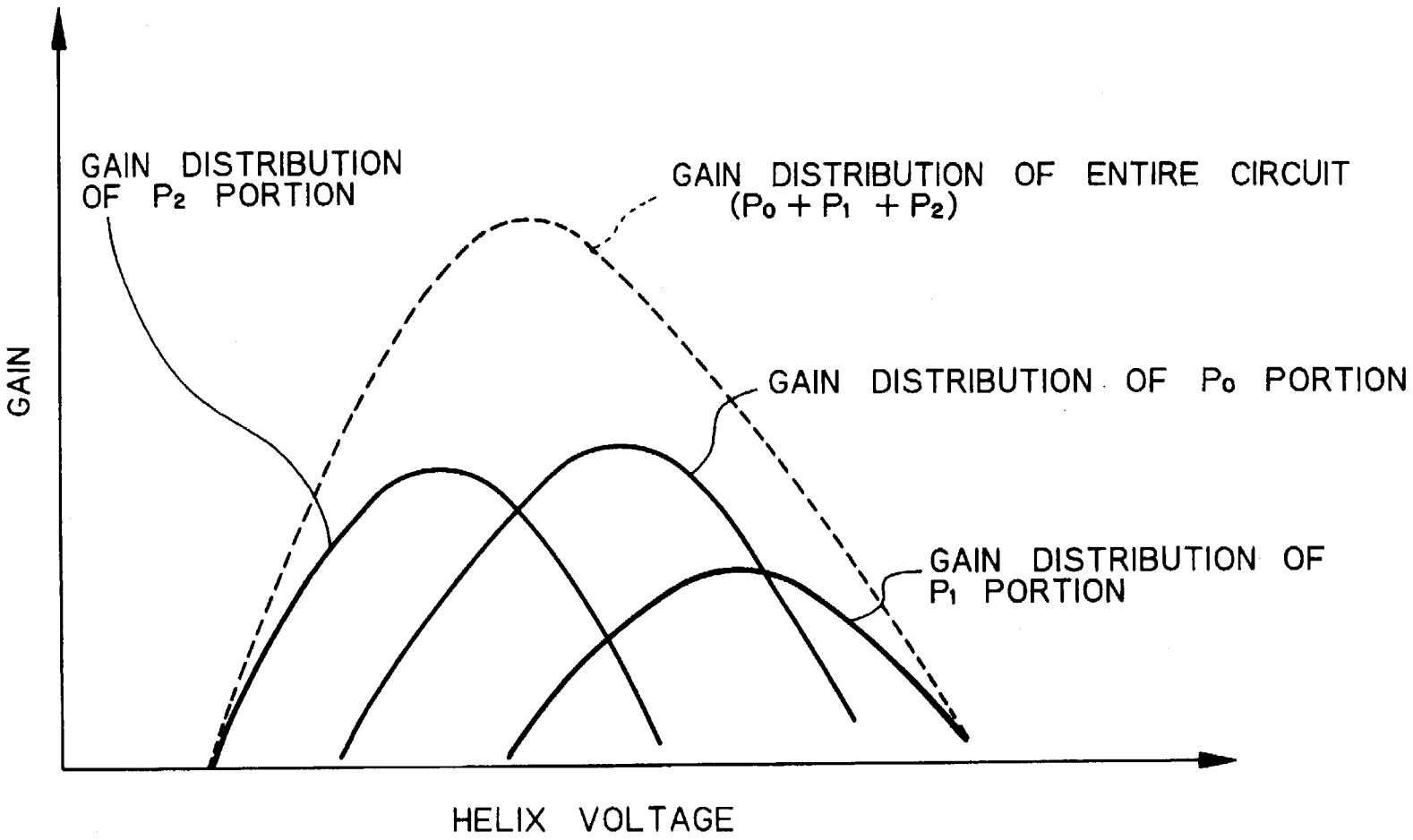
FIG. 2 is a graph demonstrating how uniform circuit period portions included in the embodiment have their lengths selected.

A reference will be made to FIG. 2 for describing how the lengths of the circuit period P0 portion and P1 portion are selected such that the small signal gain becomes maximum. For a given circuit period, a helix TW tube has a gain having a distribution against a helix voltage. Specifically, in the illustrative embodiment including the wave delay circuit 7 made up of three different circuit period portions, the gain has three distributions except for the velocity taper portions, as shown in FIG. 2. Because the total gain of the entire circuit is the sum of the three distributions, increasing the length, i.e., gain of any one of the circuit period portions causes the distribution of the total gain to increase at a voltage of the circuit period. For example, if the gain (length) of the circuit period P1 portion is increased, then the helix voltage (synchronous voltage) implementing the maximum gain of the entire circuit is shifted to the high voltage side. A decrease in the gain of the circuit period P1 portion will shift the helix voltage to the low voltage side. In this manner, the length of each circuit period portion is set such that the gain becomes maximum at a preselected voltage.

Referring again to FIG. 1, an electron beam E issuing from the electron gun 2 propagates through the helix wave delay circuit 7 while being modulated. During the propagation, the electromagnetic wave is substantially attenuated by the wave attenuator 4. However, the electromagnetic wave is again induced by the modulated beam E at the end of the output portion 9 of the circuit 7 adjoining the wave attenuator 4. As a result, the wave is amplified while advancing toward the collector 3 and interacting with the beam E. The amplified wave is output via the wave output section 6.

After computer simulation with the illustrative embodiment, a series of experiments were conducted. The results of experiments will be described with reference to FIGS. 3–8.

Figure 3:
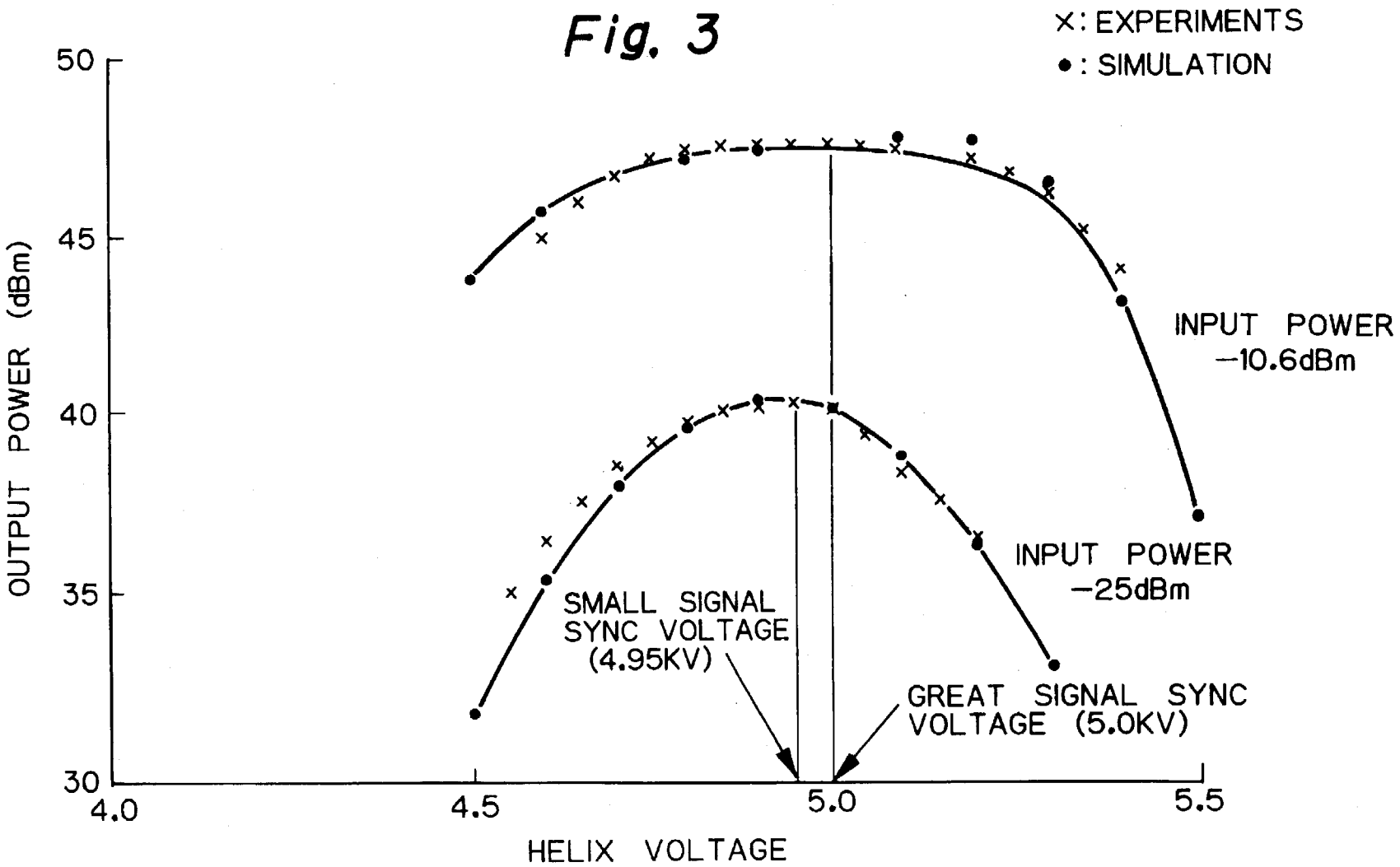
FIG. 3 is a graph plotting the results of computer simulation and the results of experiments conductive with the embodiment.
Figure 4:
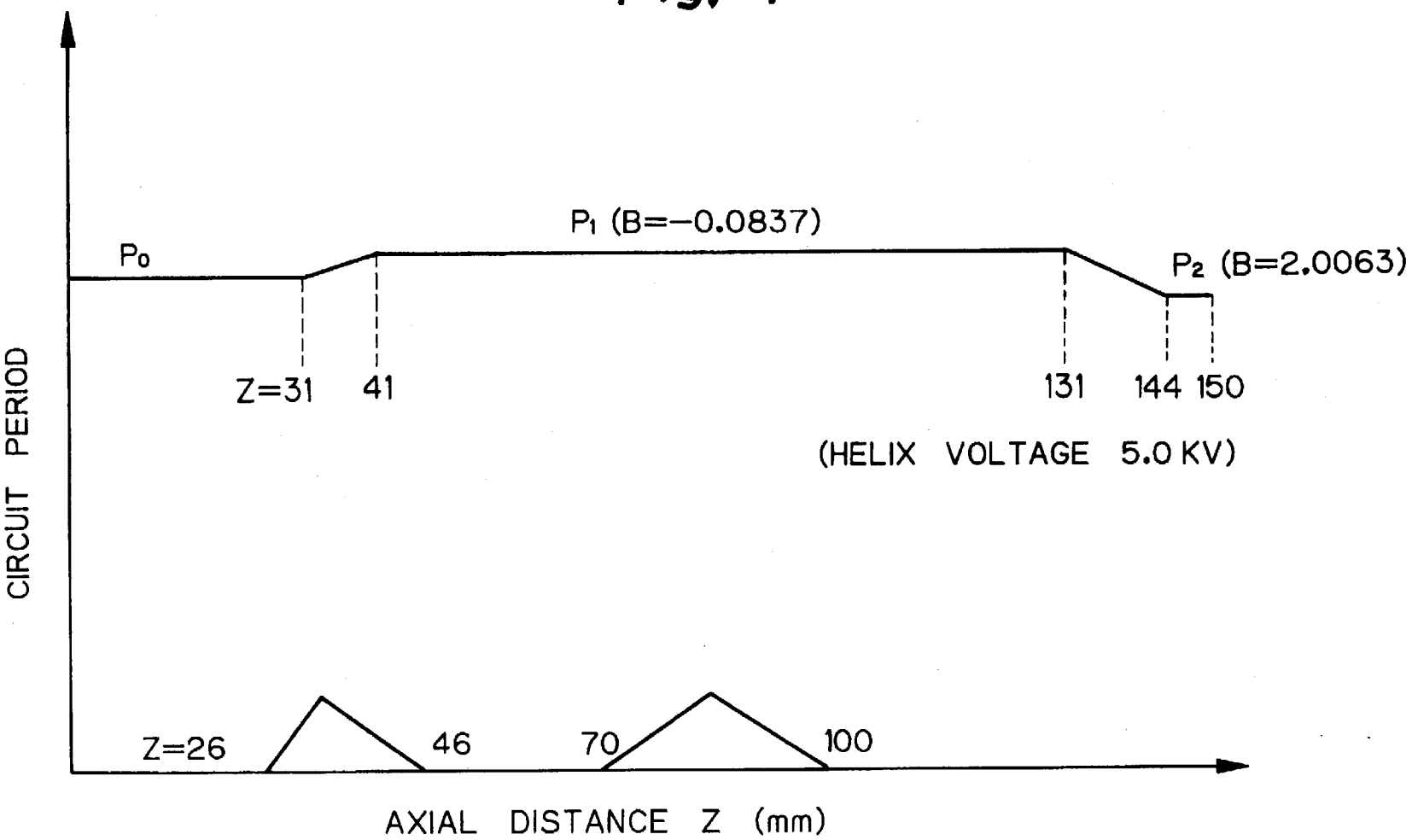
FIG. 4 shows the configuration of the helix wave delay circuit used for the simulation and experiments.

FIG. 3 shows a relation between the helix voltage and the output voltage while FIG. 4 shows the overall configuration of the circuit periods. The TW tube had a helix voltage or operation voltage of 5 kV and produced a 12 GHz band 60 W output. As shown in FIG. 3, the small signal synchronous voltage was determined to be 4.95 kV by both the computer simulation and the experiments. Further, even the large signal synchronous voltage was determined to be 5.0 V by both the computer simulation and the experiments. That is, the two voltages are substantially the same as each other. In this condition, as shown in FIG. 4, the velocity coefficients B of the circuit period P1 portion and P2 portion are respectively −0.0837 and 2.0063, and their difference ΔB is 2.0900, satisfying all the Eqs. (1)–(3). Therefore, the computer simulation and experiments proved the advantage available with the illustrative embodiment.

Figure 5:
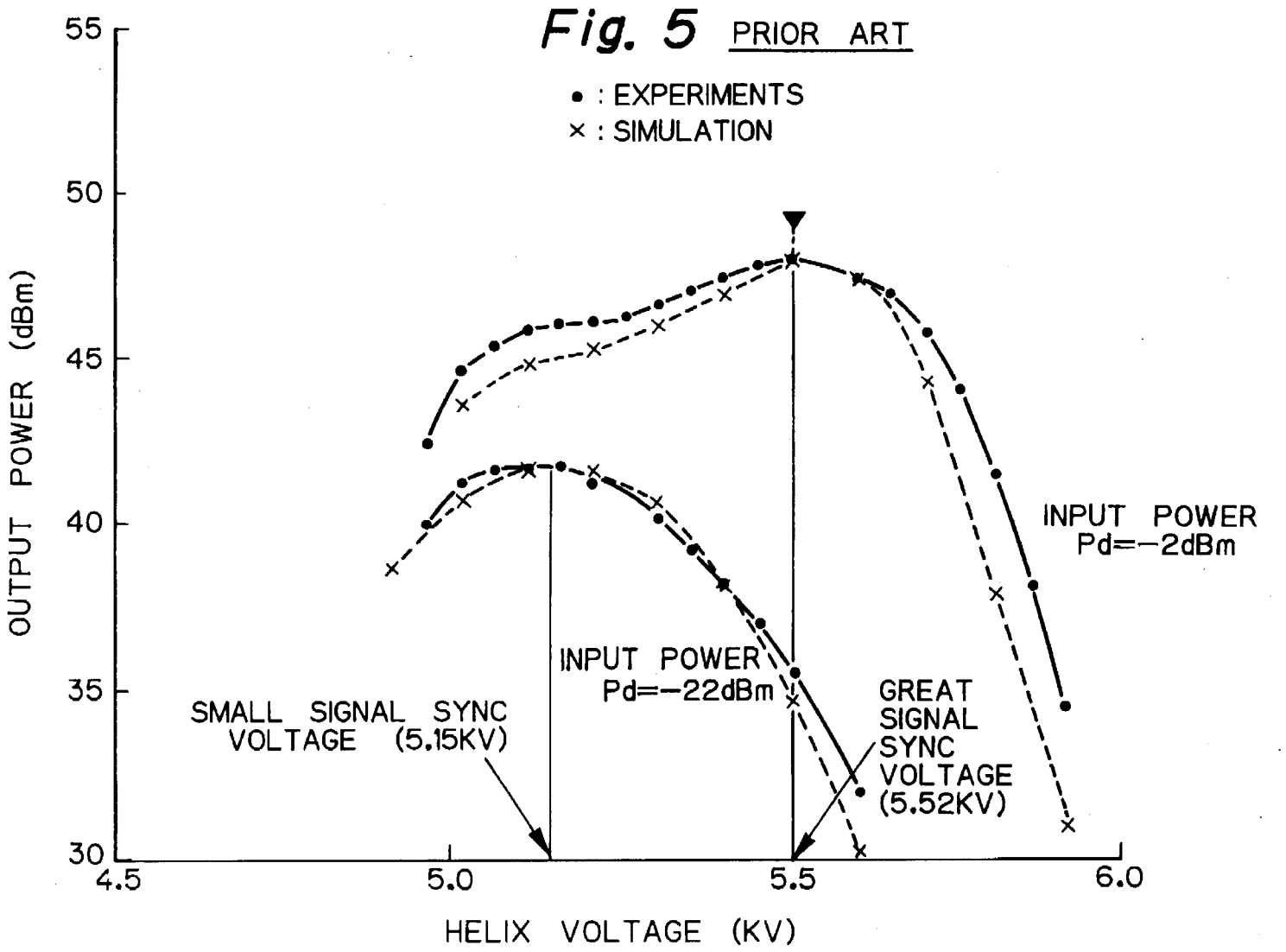
Fig. 5 PRIOR ART
FIG. 5 is a graph plotting the results of computer simulation and the results of experiments conducted with a conventional helix TW tube.
Figure 6:
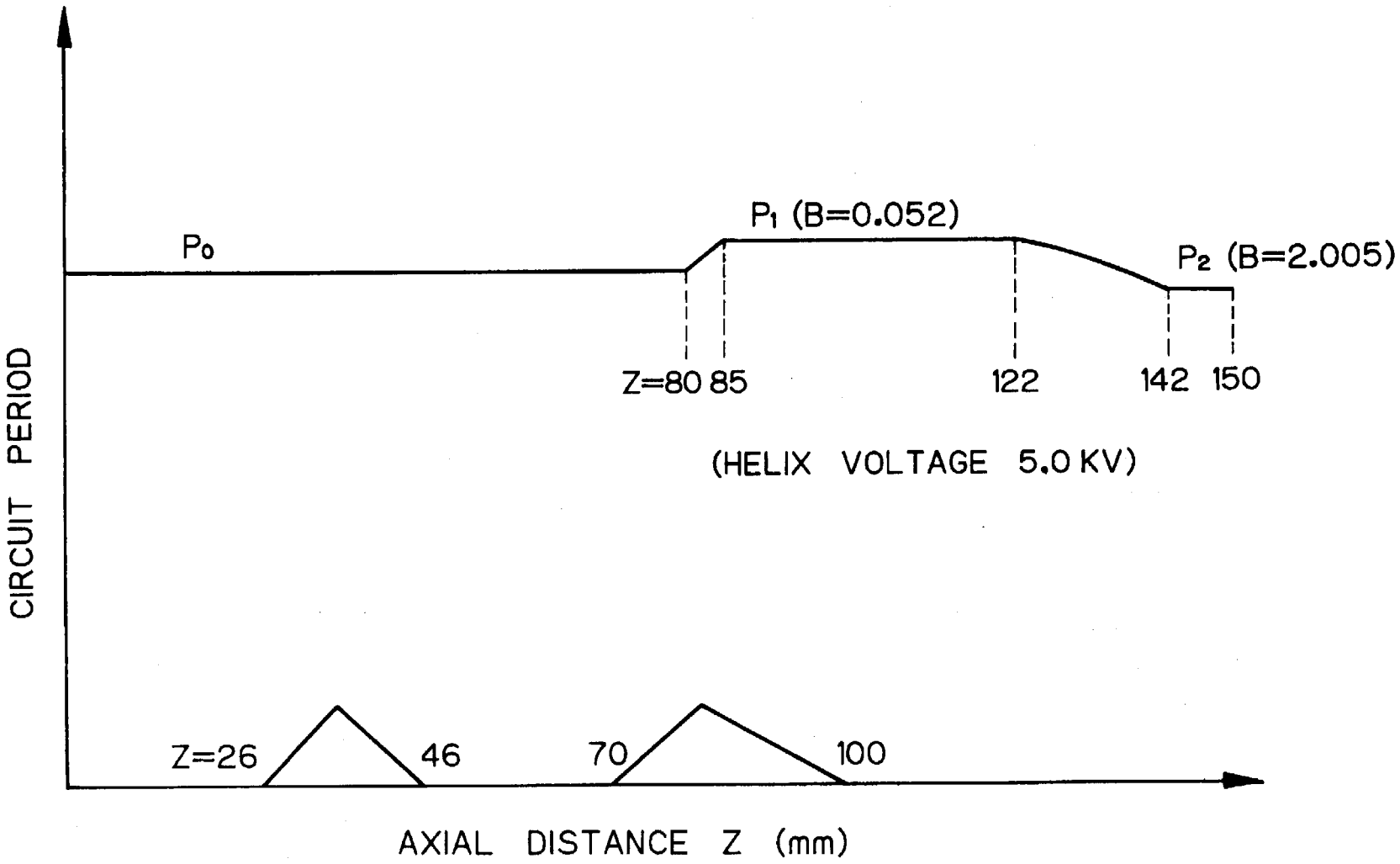
Fig. 6 PRIOR ART
FIG. 6 shows the configuration of a helix wave delay circuit included in the conventional tube and used for the simulation and experiments.

Computer simulation and the results of experiments conducted with a conventional TW tube will be described for comparison. The tube had a helix voltage or operation voltage of 5.5 kV and produced an output of 12 GHz band 60 W output. FIG. 5 shows a relation between the helix voltage and the output power while FIG. 6 shows the overall configuration of the circuit periods. As shown in FIG. 5, the small signal synchronous voltage is 5.15 kV while the large signal synchronous voltage is 5.52 V, so that a difference is as great as 370 V (6.7%). Such a difference brings about a corresponding decrease in gain and a corresponding variation in gain against the helix voltage. In this condition, as shown in FIG. 6, the velocity coefficients B of the circuit period P1 portion and period P2 portion are respectively 0.052 and 2.005, and their difference ΔB is 1.953. Although such parameters satisfy the Eqs. (1)–(3), the lengths of the circuit period P0 portion and P2 portion are not adequate; the small signal synchronous voltage is far from the voltage (about 5.52 kV) that sets up the velocity coefficient B of 1.95 to 2.1 at the circuit period P2 portion.

Figure 7:
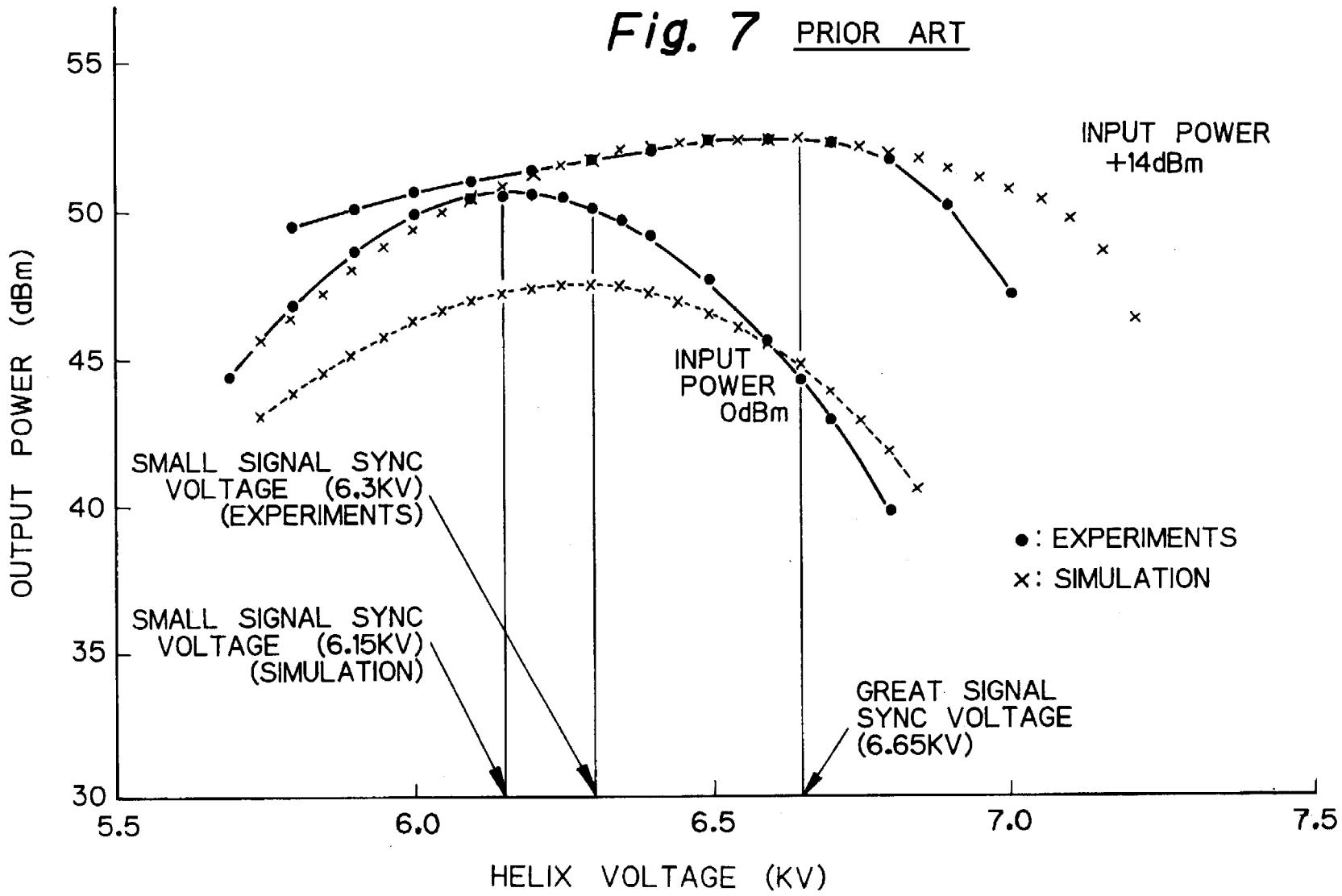
Fig. 7 PRIOR ART
FIG. 7 is a graph plotting the results of computer simulation and the results of experiments conducted with another conventional TW tube.
Figure 8:
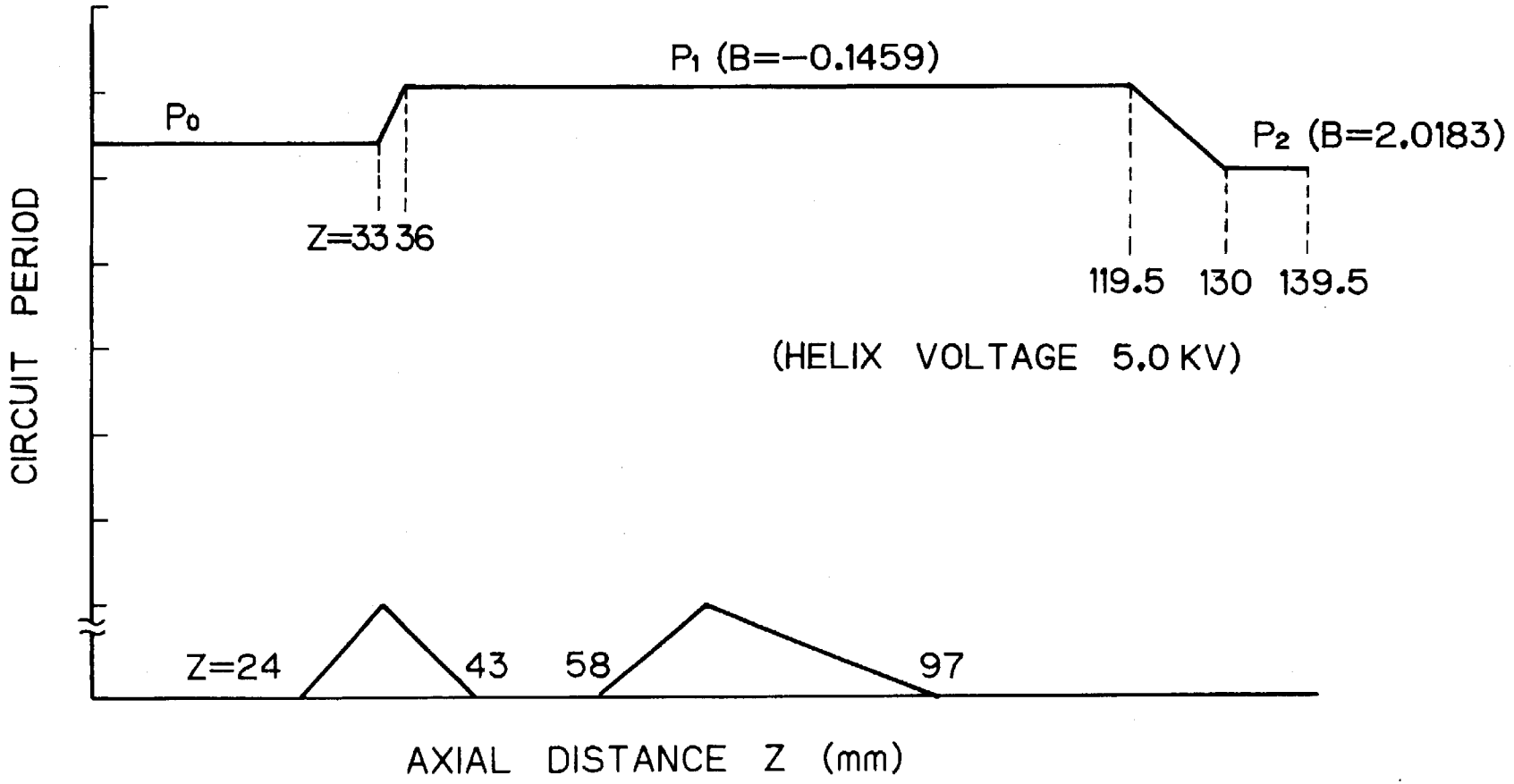
Fig. 8 PRIOR ART
FIG. 8 shows the configuration of a helix wave delay circuit included in the tube shown in FIG. 7 and used for the simulation and experiments.

Computer simulation and the results of experiments conducted with another conventional TW tube are as follows. The tube had a helix voltage or operation voltage of 6.65 kV and produced an output of 12 GHz band 120 W output. FIG. 7 shows a relation between the helix voltage and the output power while FIG. 8 shows the overall configuration of the circuit periods. As shown in FIG. 7, the small signal synchronous voltage is 6.15 kV according to the simulation or 6.3 kV according to the experiments while the great signal synchronous voltage is 5.52 V, so that a difference is as great as 350 V to 500 V (6.7%). Such a difference brings about a corresponding decrease in gain and a corresponding variation in gain against the helix voltage. In this condition, as shown in FIG. 8, the velocity coefficients B of the circuit period P1 portion and P2 portion are respectively −0.1459 and 2.0183 which do not satisfy the Eqs. (1)–(3). While the velocity taper portion between the circuit period P0 portion and the circuit period P1 portion is shifted to the input side, such a configuration cannot achieve the object alone, as determined by the experiments.

For given design parameters, i.e., basic parameters including a circuit perviance γa, a TW tube can be most effectively miniaturized if small signal synchronous and large signal synchronous signals are coincident. The circuit configurations shown in FIGS. 4 and 6 are based on substantially the same design parameters. In FIG. 4, the small signal gain is 65.5 d (for the helix voltage of 4.95 kV) while the large signal gain is about 58 dB (for the helix voltage of 5 kV), as shown in FIG. 3. By contrast, in FIG. 6, the great signal gain is about 50 dB (for the helix voltage of 5.5 kV) which is far from the desired gain although the small signal gain is about 64 dB (for the helix voltage of 5.5 kV), as shown in FIG. 5. Because the circuit lengths are both 150 mm, it will be seen that for a given gain the illustrative embodiment can reduce the circuit length by about 14% (compared to 50 dB/58 dB=86.2%).

Moreover, if the lengths of the circuit period P0 portion and P1 portion are inadequate, as shown in FIGS. 5 and 6, or if the numerical values are far from the conditions represented by the Eqs. (1)–(3), as shown in FIGS. 7 and 8, the large signal synchronous and small signal synchronous voltages are deviated from each other with the result that the gain at the former voltage is reduced. To make up for the decrease in gain, it is necessary to increase the circuit length. This obstructs the miniaturization of the TW tube.

In summary, in a helix TW tube in accordance with the present invention, when a small signal synchronous voltage is lower than a preselected voltage, a uniform circuit period P0 portion and a uniform circuit period P1 portion are respectively configured short and long. Conversely, when the synchronous voltage is higher than the preselected voltage, the circuit period P0 portion and circuit period P1 portion are respectively configured long and short. This stems from the fact that high frequency amplification by a helix delay circuit has a distribution against the DC velocity of electrons; when the circuit period varies in the axial direction, the distribution accumulates for each circuit period. Therefore, the present invention allows the two synchronous voltages to coincide or be extremely close to each other and thereby allows the circuit to have a minimum length. This implements a small size and light weight helix TW tube involving a minimum of gain variation against voltage variation.

Various modifications will become possible for those skilled in the art after receiving the teachings of the present disclosure without departing from the scope thereof.

What is claimed is:

1. A travelling-wave tube comprising an electron gun, a collector, a high frequency input section, a high frequency output section, and a helix wave delay circuit divided halfway by a high frequency attenuator with respect to frequency, said helix wave delay circuit comprises a uniform circuit period P0 portion having a uniform circuit period P0, a velocity taper portion where a circuit period varies from P0 to P1, a uniform circuit period P1 portion having a uniform circuit period P1 greater than P0, a velocity taper portion where the circuit period Varies from P1 to P2, and a uniform circuit period P2 portion having a uniform circuit period P2 smaller than P1, as named from a side adjoining said high frequency input section, and a velocity coefficient B expressed, assuming that a circuit wave has a phase velocity v0, that electrons have a DC velocity u0, and that the circuit has a coupling coefficient C, as:

$$B=(u0-v0)/(C\cdot v0) \qquad \text{Eq. (0)}$$

is confined, in said uniform circuit period P1 portion, in a range of:

$$-0.1<B<0.1 \qquad \text{Eq. (1)}$$

and confined, in said uniform circuit period P2 portion, in a range of:

$$1.95<B<2.05 \qquad \text{Eq. (2)}$$

and a difference ΔB between said velocity coefficients B is selected to lie in a range of:

$$1.95<\Delta B<2.1 \qquad \text{Eq. (3)}$$

and said uniform circuit period P0 portion and said uniform circuit period P1 portion each has a particular length selected such that a small signal gain becomes maximum at a voltage satisfying said Eqs. (1)–(3).

2. A tube as claimed in claim 1, wherein to satisfy said Eqs. (1)–(3) said circuit periods P1 and P2 are adjusted to thereby adjust a phase velocity v0 of a circuit wave.

3. A tube as claimed in claim 1, wherein a length of said uniform circuit period P0 portion and a length of said uniform circuit period P1 portion are so set as to maximize the small signal gain at the voltage satisfying said Eqs. (1)–(3) by adjusting a gain distribution of each of said uniform circuit period P1 portion and said uniform circuit period P2 portion against the voltage.

* * * * *

UNITED STATES PATENT AND TRADEMARK OFFICE

CERTIFICATE OF CORRECTION

PATENT NO. : 5,723,948

DATED : March 3, 1998

INVENTOR(S) : Mitsuru YOSHIDA

It is certified that error appears in the above-identified patent and that said Letters Patent is hereby corrected as shown below:

Column 4, line 4 delete "P(2aπ)" and insert --P/(2aπ)--.

Signed and Sealed this

Twenty-second Day of December, 1998

*Attest:*

*Attesting Officer*

BRUCE LEHMAN

*Commissioner of Patents and Trademarks*